US006952921B2

(12) United States Patent
Qiu

(10) Patent No.: US 6,952,921 B2
(45) Date of Patent: Oct. 11, 2005

(54) HEATER HEAD ASSEMBLY SYSTEM AND METHOD

(75) Inventor: Songgang Qiu, Richland, WA (US)

(73) Assignee: Stirling Technology Company, Kennewick, WA (US)

( * ) Notice: Subject to any disclaimer, the term of this patent is extended or adjusted under 35 U.S.C. 154(b) by 0 days.

(21) Appl. No.: 10/687,553

(22) Filed: Oct. 15, 2003

(65) Prior Publication Data

US 2005/0081520 A1 Apr. 21, 2005

(51) Int. Cl.[7] ..... F01B 29/10
(52) U.S. Cl. ..... 60/517; 60/524; 60/526
(58) Field of Search ..... 60/517, 520, 526

(56) References Cited

U.S. PATENT DOCUMENTS 4,050,250 A * 9/1977 Danis ..... 60/517
4,389,844 A * 6/1983 Ackermann et al. ..... 60/517
4,433,279 A * 2/1984 Bhate ..... 322/3
4,638,633 A * 1/1987 Otters ..... 60/518
5,743,091 A * 4/1998 Penswick et al. ..... 60/517
5,918,463 A * 7/1999 Penswick et al. ..... 60/517

* cited by examiner

*Primary Examiner*—Hoang Nguyen
(74) *Attorney, Agent, or Firm*—Brian L. Johnson; George C. Rondeau, Jr.; Davis Wright Tremaine LLP

(57) ABSTRACT

A heater head assembly is provided with potential advantages of low assembly and integration requirements. A significant portion of the heater head assembly is formed or machined as a single piece of material to reduce assembly demands. The heater head assembly has a planar surface to reduce complications involved with integration of the heater head assembly with various sources of heat.

25 Claims, 7 Drawing Sheets

HEATER HEAD ASSEMBLY SYSTEM AND METHOD

BACKGROUND OF THE INVENTION

1. Field of the Invention

The present invention is directed generally to Stirling cycle based generators and, more particularly, to associated heater head assemblies.

2. Description of the Related Art

Sterling cycle based generators use heater head assemblies along with other components to help convert heat into mechanical motion and to use mechanical motion to pump undesired heat. Unfortunately, conventional heater head assemblies typically contain many parts that have demanding assembly requirements. These conventional heater head assemblies also present unwelcome challenges involving integration with available sources of heat.

BRIEF SUMMARY OF THE INVENTION

One aspect of the present invention resides in a Stirling cycle system having an acceptor with an external planar surface constructed to pass heat when coupled to a heat source.

Another aspect of the invention resides in a body for a Stirling cycle system where the body has a unitary construction comprising an acceptor portion with a plurality of passageways formed at least in part therein, an outer wall of a regenerator portion, and an outer wall of a rejector portion with a one-piece construction. The acceptor portion is fluidly coupled to the regenerator portion and the regenerator portion is fluidly coupled to the rejector portion. In an illustrated embodiment of a Stirling cycle system, the body is used with a power piston fluidly coupled to the rejector portion, a mover fixedly coupled to the power piston, and a stator electromagnetically coupled to the mover. In this embodiment the acceptor portion of the body has a planar surface with a plurality of channels, and system further includes an acceptor plate with a planar surface mating with the planar surface of the acceptor portion of the body and having a plurality of channels with the channels of the planar surfaces of the acceptor portion of the body and the acceptor plate together forming a plurality of fluid passageways. The acceptor plate with high conductive material has an external planar surface constructed to pass heat effectively when coupled to a heat source.

The body may include rejector members being of one-piece with the acceptor portion, the outer wall of the regenerator portion and the outer wall of the rejector portion, and projecting from the outer wall of the rejector portion of the body.

Other features and advantages of the invention will become apparent from the following detailed description, taken in conjunction with the accompanying drawings.

BRIEF DESCRIPTION OF THE SEVERAL VIEWS OF THE DRAWING(S)

DETAILED DESCRIPTION OF THE INVENTION

As disclosed herein, a heater head assembly is provided with potential advantages of low assembly and integration requirements. A significant portion of the heater head assembly is machined or formed as a single piece of material to reduce assembly demands. The heater head assembly has a planar surface to reduce complications involved with integration of the heater head assembly with various sources of heat.

Figure 1:
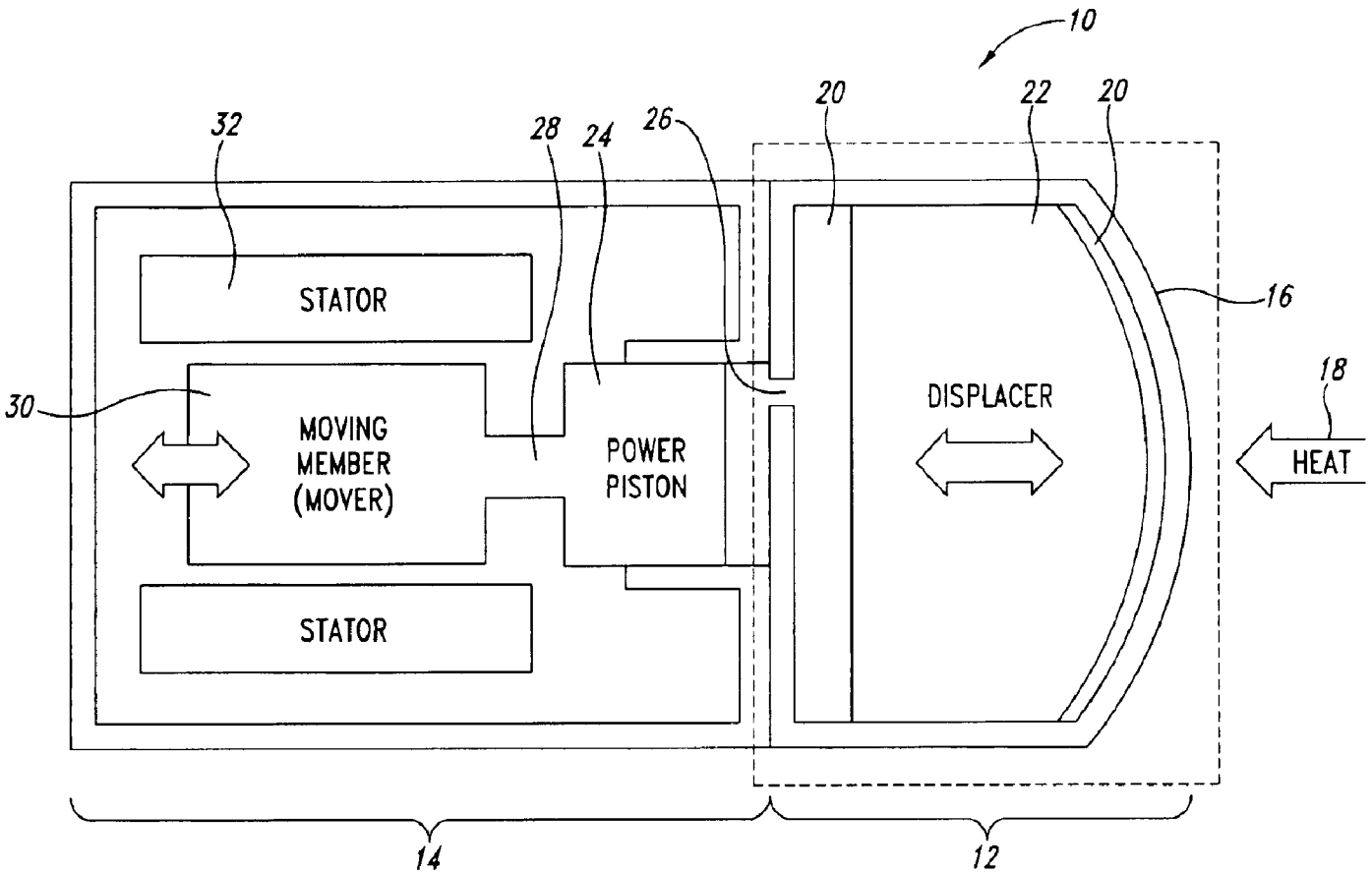
Fig. 1 (Prior Art)
FIG. 1 is a conventional Stirling cycle based system depicting major components.

A conventional Stirling cycle based system 10 is shown in FIG. 1 as having a displacer component 12 and a power conversion component 14. As a Stirling cycle generator, a heater head assembly 16 of the displacer component 12 transfers heat from a heat source 18 to a working fluid 20. Consequently, with a displacer 22 of the displacer component 12 and a power piston 24 of the power conversion component 14 are caused to linearly and reciprocally move. The power piston 24 is in fluid communication with the displacer 22 through a port 26, which acts as an interface for the working fluid 20 between the displacer component 12 and the power conversion component 14. As conventionally known, the power piston 24 is coupled through a shaft 28 to a mover 30, which electromagnetically interacts with a stator 32 to produce electrical power.

Figure 2:
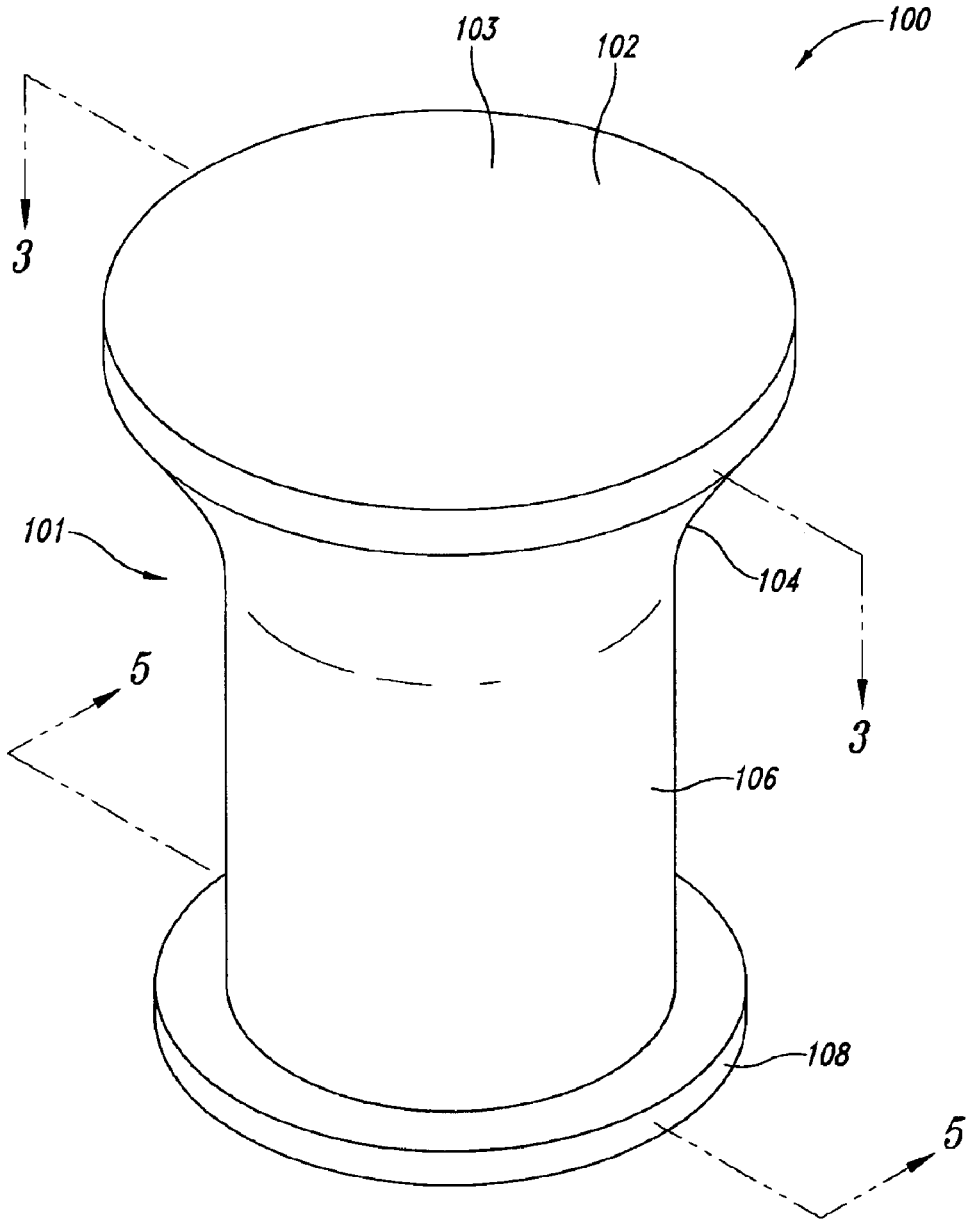
FIG. 2 is an isometric view of a depicted implementation of a heater head assembly.

An implementation of a heater head assembly 100 according to the present invention is shown in FIG. 2. The heater head assembly 100 has a body 101 with a conical portion 104 and a cylindrical portion 106. In general, heater head assemblies include three heat exchangers (an acceptor, a regenerator, and a rejector) whose operation are conventionally known and will not be elaborated herein other than when appropriate for discussion regarding the configuration of the heater head assembly 100. The heater head assembly 100 has a heat acceptor 102 formed in part by an acceptor plate 103 having an external planar surface to be used for integration with a heat source (not shown). Heat transfer analysis and design regarding planar surfaces can be less demanding than with other shapes, so less demanding efforts may be required to integrate the heater head assembly 100 with a source of heat. In other implementations, the heat aceptor 102 can have fins or an enhanced surface to allow for increased radiative or convective heat transfer.

The heat acceptor 102 is further formed in part by an end portion of the conical portion 104 of the heater head assembly 100 to which the acceptor plate 103 is attached, as elaborated below. The heater head assembly 100 further includes a flange portion 108 at an end opposite the acceptor 102 for coupling with a power conversion component (not shown).

Figure 3:
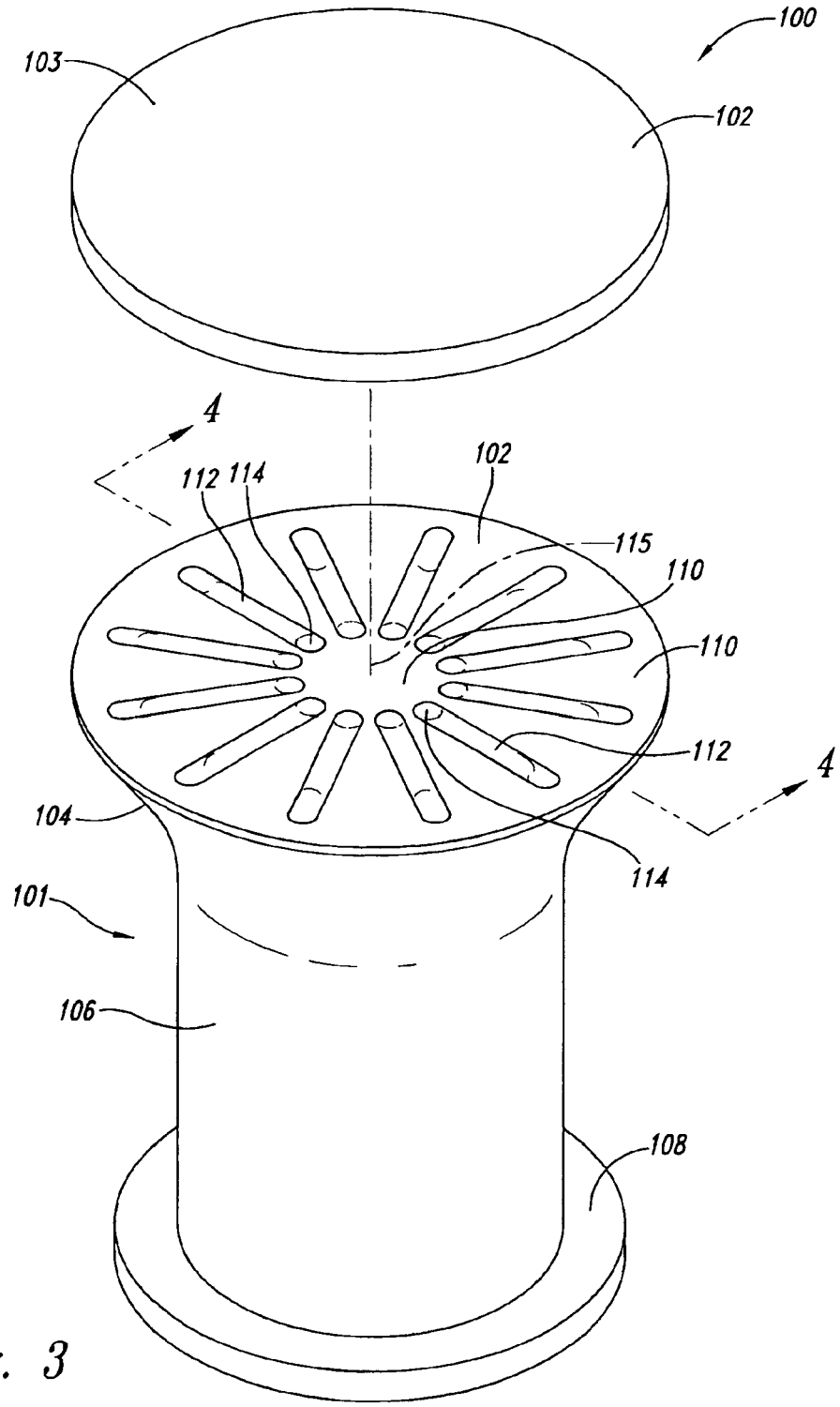
FIG. 3 is an exploded isometric view of the depicted implementation of the heater head assembly shown in FIG. 2.
Figure 4:
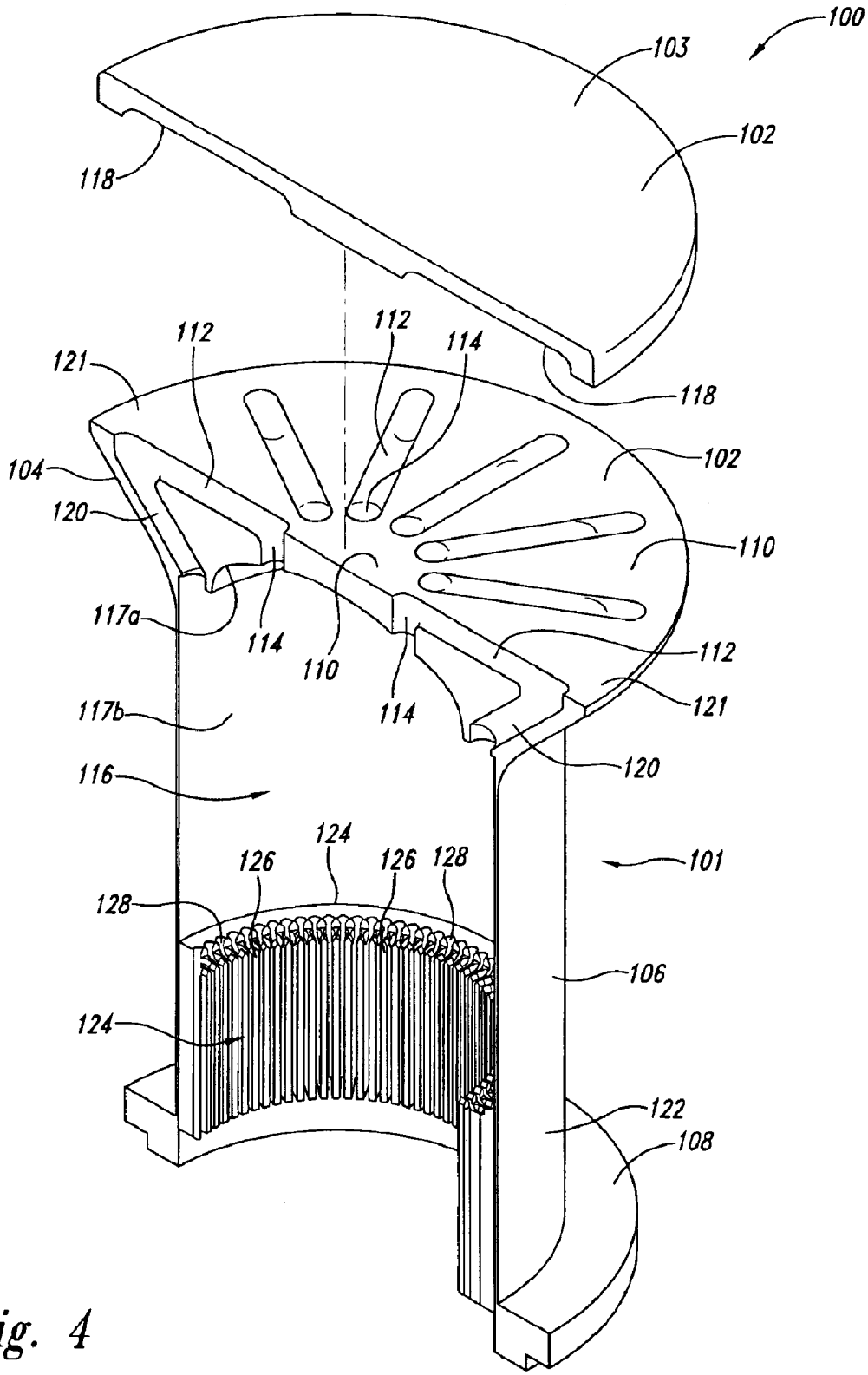
FIG. 4 is an exploded cross-sectional isometric view of the depicted implementation of the heater head assembly shown in FIG. 2 without a cylindrical sleeve and without regenerator material installed.
Figure 5:
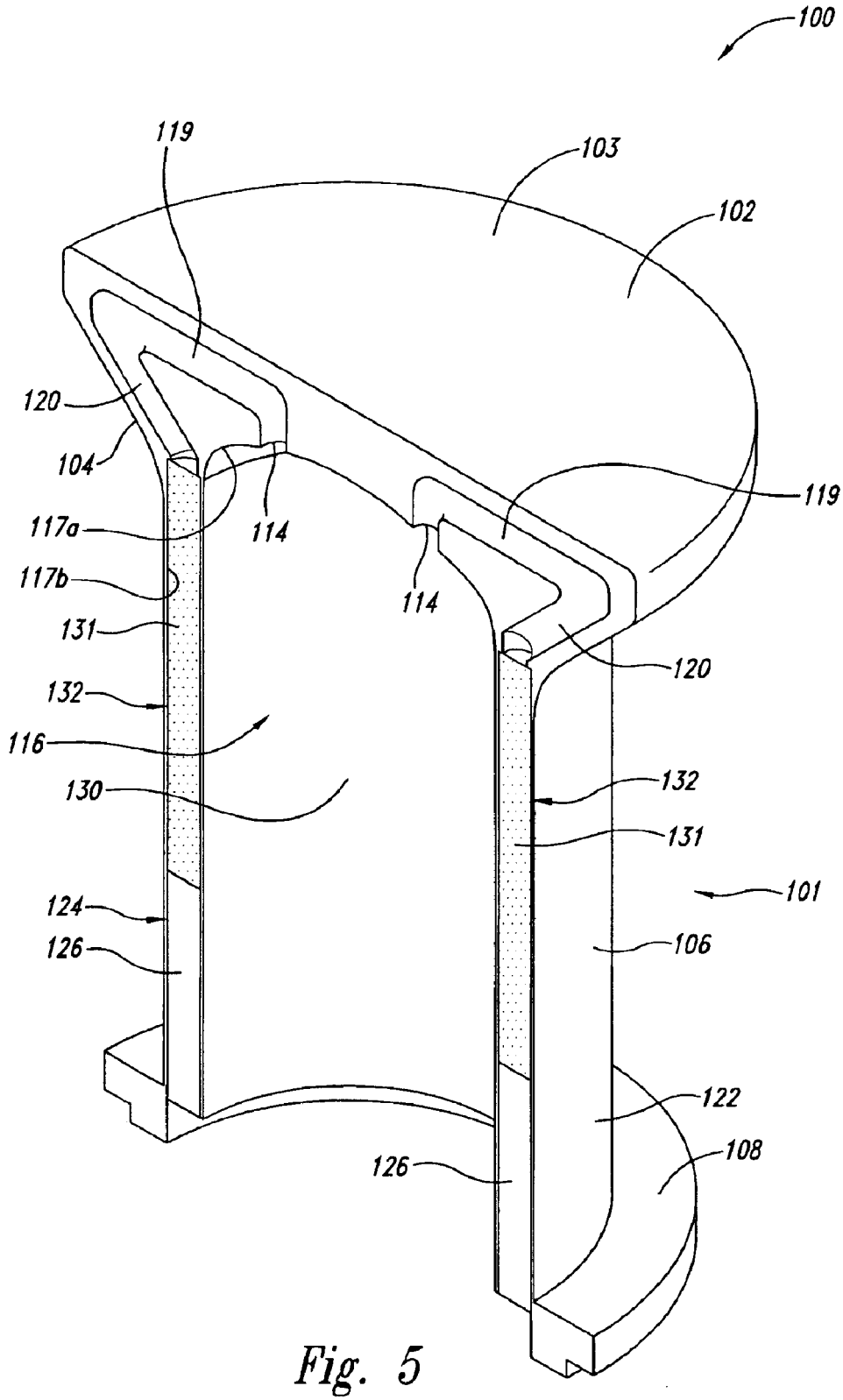
FIG. 5 is an exploded cross-sectional isometric view of the depicted implementation of the heater head assembly shown in FIG. 2 with the cylindrical sleeve and regenerator material installed.

As shown in FIG. 3, the conical portion 104 has a planar surface 110 and twelve channels 112 (number of channels can vary with implementation), each radially dispersed from an associated opening 114 near a central portion 115 of the planar surface. As shown in FIG. 4, the openings 114 couple to an interior volume 116 of the heater head assembly 100 formed by an interior domed surface 117*a* of the conical portion 104 and an interior cylindrical surface 117*b* of an outer wall 119 of the cylindrical portion 106. The acceptor plate 103 also has the same number of radially dispersed channels 118 that together with the radially dispersed channels 112 of the conical portion 104 form horizontal passageways 119 (best shown in FIG. 5) when the acceptor plate is coupled to the conical portion. While twelve passageways are illustrated, other numbers of passageways may be used. The acceptor plate 103 can be welded or brazed on to the planar surface 110 of the conical portion 104 in a simple assembly operation.

The conical portion 104 further includes canted passageways 120 that couple to the horizontal passageways 119 near a periphery 121 of the planar surface 110 of the conical portion 104. The canted passageways 120 open into the interior volume 116 near the interior cylindrical surface 117*b* of the cylindrical portion 106.

A lower section 122 of the cylindrical portion 106 has a rejector 124 extending radially inward from the interior cylindrical surface 117*b* of the outer wall 119 of the cylindrical portion 106 into the interior volume 116. The rejector 124 includes fins 126 extending into the interior volume 116 (best seen in FIG. 4). The fins 126 are depicted as vertically oriented longitudinal members separated by channels 128. Other implementations can be adopted having other fin orientations and configurations or other types of heat exchangers, such as tubular heat exchangers, etc. As is conventional knowledge, the fins 126 act to conduct heat from the working fluid. The heat may be transferred to a conventional water jacket (not shown) surrounding the lower section 122 of the cylindrical portion 106.

In the illustrated embodiment, as best seen in FIG. 4, the body 101 could have a unitary construction with the conical portion 104, the cylindrical portion 106 and the rejector 124 being formed from a single machined or formed piece of material and having a one-piece construction. While the rejector 124 is shown as a part of the one-piece construction, in other embodiments the rejector 124 may be separately fabricated and attached to the lower section 122 of the cylindrical portion 106, as are the acceptor plate 103 and the flange portion 108 in the illustrated embodiment. By being formed as a separate part, the acceptor plate 103 and the conical portion 104 can be made of a high thermally conductive material (such as a nickel alloy) whereas the cylindrical portion 106 can be made of a lower thermally conductive material with higher strength characteristics. The flange portion 108 can be made of yet another material based upon specifications such as those directed to weight and strength requirements.

Another part of the heater head assembly 100 that typically constitutes a separate part is a cylindrical sleeve 130 that is press fit into the interior volume 116. During assembly, before the cylindrical sleeve 130 is put in place, regenerator material 131 for a regenerator 132 is fitted against the interior cylindrical surface 117*b* of the cylindrical portion 106 and extends inwardly approximately the same extent as the rejector 124 extends inwardly. The regenerator material 131 is typically a metal matrix or some other material conventionally used for regenerators. With the regenerator material 131 in place, the cylindrical sleeve 130 is fitted in the heater head assembly 100 as an inner cylindrical wall concentric to the interior cylindrical surface 117*b* of the cylindrical portion 106. The interior cylindrical surface 117*b* and the cylindrical sleeve 130 form a cylindrically shaped space therebetween in which the regenerator material 131 is positioned.

Figure 6:
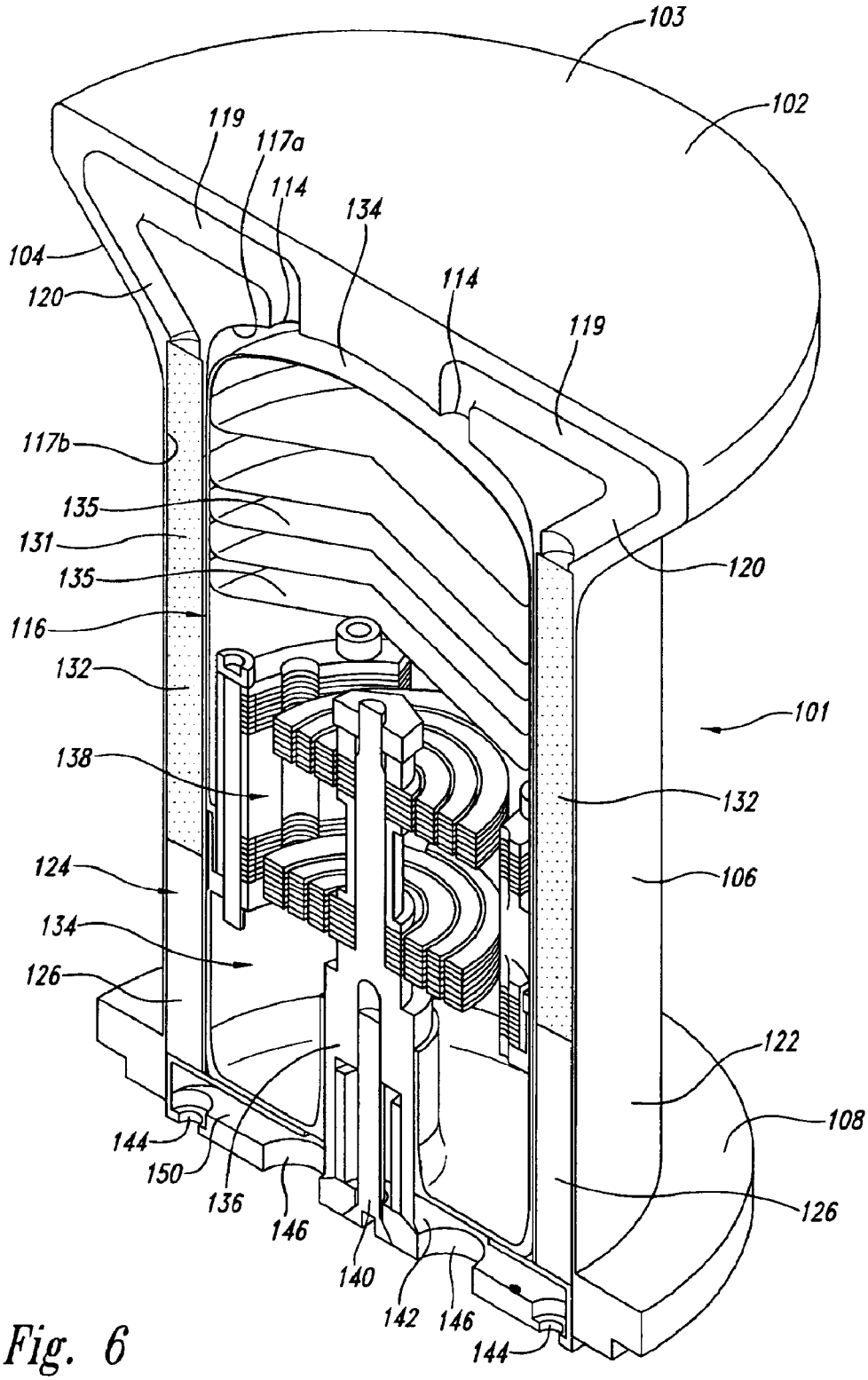
FIG. 6 is an exploded cross-sectional isometric view of the depicted implementation of the heater head assembly shown in FIG. 2 containing a displacer joined to a spider plate.
Figure 7:
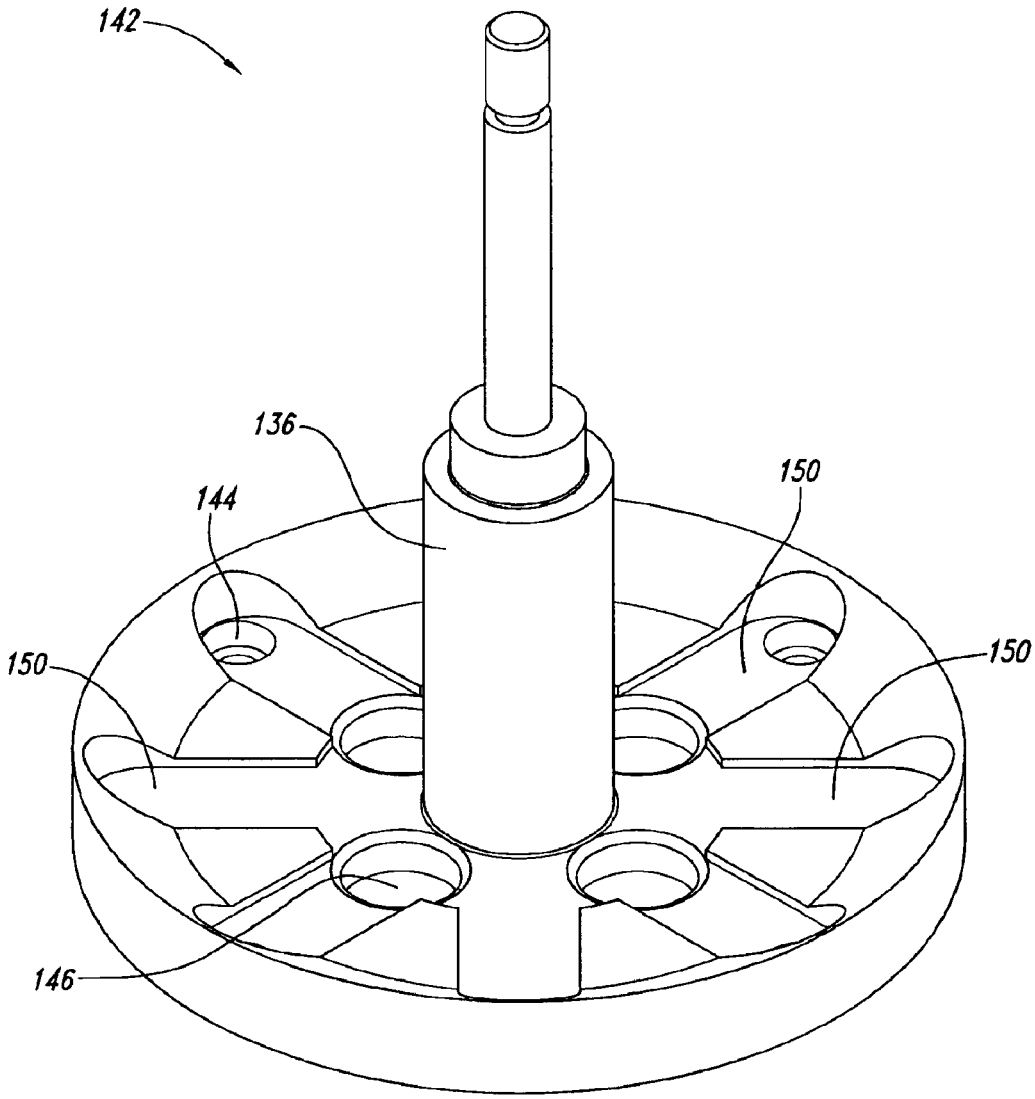
FIG. 7 is an isometric view of the spider plate and also includes the post of the displacer.

A displacer 134 with conventional buffer spacer 135 is shown in FIG. 6 positioned inside of the interior volume 116. The displacer 134 is coupled to a post 136 through flexure bearings 138, which is in turn coupled with a screw 140 to a spider plate 142. Further shown in FIG. 7, the spider plate 142 includes bolt holes 144 for bolts (not shown) to secure the spider plate and the rest of the heater head assembly 100 along with the displacer 134 to a power conversion component (not shown). The spider plate 142 has ports 146 for fluid communication between a power piston (not shown) of the power conversion component (not shown) and the displacer 134. The spider plate 142 further has channels 150 to conduct working fluid between the rejector 124 and the ports 146. Consequently, a continuous fluid path exists for working fluid provided by the following spaces: between the displacer 134 and the interior domed surface 117*a* of the conical portion 104, the horizontal passageways 119, the canted passageways 120, the regenerator 132, the channels 128 of the rejector 124, the channels 150 of the spider plate 142, and the ports 146 of the spider plate.

From the foregoing it will be appreciated that, although specific embodiments of the invention have been described herein for purposes of illustration, various modifications may be made without deviating from the spirit and scope of the invention. Accordingly, the invention is not limited except as by the appended claims.

What is claimed is:

1. A heater head assembly for a Stirling cycle system, the heater head assembly comprising:

a body being of unitary construction, with a conically shaped body portion and a cylindrically shaped body portion being of one-piece construction and together defining an interior volume:

the conically shaped body portion having a planar surface constructed to pass heat when the heater head assembly is coupled to a heat source, a domed shaped interior surface, and a plurality of passageways being formed at least in part in the conically shaped portion; and the cylindrically shaped body portion having first and second sections, the first section of the cylindrically shaped body portion having a cylindrical interior surface, and the second section of the cylindrically shaped body portion having rejector members extending radially inward into the interior volume with innermost portions thereof defining a cylindrical inward surface concentric with the cylindrical interior surface of the first section of the cylindrical shaped body portion;

regenerator material having a first surface positioned against the cylindrical interior surface of the first section of the cylindrically shaped body portion, the regenerator material extending radially inward into the interior volume and having an cylindrical inward second surface in inward positional alignment with the cylindrical inward surface of the rejector members; and a cylindrical sleeve having an outer diameter sized to be adjacent to the cylindrical inward surface of the rejector members and to the cylindrical inward second surface of the regenerator material.

2. The heater head assembly of claim 1 further comprising a spider plate coupled to the cylindrical shaped body and having channels and ports providing fluid communication of the heater head assembly with a power conversion component of the Stirling cycle system.

3. The heater head assembly of claim 1 wherein the planar surface of the conically shaped body portion includes a plurality of channels, and the heater head assembly further includes an acceptor plate with a planar surface mating with the planar surface of the conically shaped body portion and having for a plurality of channels, the channels of the planar surfaces of the conically shaped body portion and the acceptor plate together forming the plurality of passageways.

4. The heater head assembly of claim 3 wherein the acceptor plate has an external planar surface constructed to pass heat when coupled to a heat source.

5. A heater head assembly for a Stirling cycle system, the heater head assembly comprising:

a body being of unitary construction with a first end body portion, a second end body portion and a third body portion between the first and second end body portions, the first, second and third body portions being of one-piece construction and together defining an interior volume:

the first end body portion having a planar surface constructed to pass heat when the heater head assembly is coupled to a heat source, and a plurality of passageways formed at least in part in the first end body portion;

the second end body portion having rejector members extending inward into the interior volume and defining inward end portions; and the third body portion having an interior surface;

regenerator material having an outward surface positioned against the interior surface of the third body portion, the regenerator material extending inward into the interior volume generally coextensive with the rejector members and having an inward surface;

a sleeve having an outer size to be adjacent to the inward end portions of the rejector members and to the inward surface of the regenerator material; and a member coupled to the second end body portion and having channels and ports providing fluid communication of the heater head assembly with a power conversion component of the Stirling cycle system.

6. The heater head assembly of claim 5 wherein the first end body portion further includes a conical portion.

7. The heater head assembly of claim 5 wherein the planar surface of the first end body portion includes a plurality of channels, and the heater head assembly further includes an acceptor plate with a planar surface mating with the planar surface of the first end body portion and having for a plurality of channels, the channels of the planar surfaces of the first end body portion and the acceptor plate together forming the plurality of passageways.

8. The heater head assembly of claim 7 wherein the acceptor plate has an external planar mounting surface for mounting of the heat source thereto and constructed to pass heat when coupled to the heat source.

9. A heater head assembly for a Stirling cycle system, the heater head assembly comprising:

a body with a first end body portion, a second end body portion a third body portion between the first and second end body portions, the first, second and third body portions together defining an interior volume, wherein:

the first end body portion has a heat conducting planar external surface for positioning adjacent to a heat source to transfer heat to the first body end portion from the heat source when the heater head assembly is positioned adjacent to the heat source, the first end body portion further has a plurality of fluid passageways formed therein and communicating with the interior volume;

the second end body portion has rejector members extending inward into the interior volume and defining inward end portions; and the third body portion has an interior surface;

regenerator material positioned in the interior volume and having an outward surface positioned against the interior surface of the third body portion, the regenerator material extending inward into the interior volume generally coextensive with the rejector members and having an inward surface;

a sleeve positioned in the interior volume and having a sleeve wall adjacent to the inward end portions of the rejector members and to the inward surface of the regenerator material; and a member coupled to the second end body portion and having channels and ports providing fluid communication of the heater head assembly with a power conversion component of the Stirling cycle system.

10. A Stirling cycle system comprising:

a body having an acceptor portion with a plurality of passageways formed at least in part therein, an outer wall of a regenerator portion, and an outer wall of a rejector portion, with the acceptor portion being fluidly coupled to the regenerator portion and the regenerator portion being fluidly coupled to the rejector portion, the acceptor portion, the outer wall of the regenerator portion and the outer wall of the rejector portion being of one-piece construction;

a power piston fluidly coupled to the rejector portion;

a mover fixedly coupled to the power piston; and a stator electromagnetically coupled to the mover.

11. The Stirling cycle system of claim 10 wherein the acceptor portion of the body has a planar surface with a plurality of channels, and the system further includes an acceptor plate with a planar surface mating with the planar surface of the acceptor portion of the body and having a plurality of channels with the channels of the planar surfaces of the acceptor portion of the body and the acceptor plate together forming a plurality of fluid passageways.

12. The Stirling cycle system of claim 10 wherein the acceptor portion of the body has a plurality of channels, and the system further includes an acceptor member mating with the acceptor portion of the body and having a plurality of channels with the channels of the acceptor portion of the body and the acceptor member together forming a plurality of fluid passageways, the acceptor member having a heat conducting planar external surface for positioning adjacent to a heat source to transfer heat to the acceptor portion of the body from the heat source when the acceptor member is positioned adjacent to the heat source.

13. The Stirling cycle system of claim 10 wherein the body further includes rejector members being of one-piece construction with the acceptor portion, the outer wall of the regenerator portion and the outer wall of the rejector portion, and projecting from the outer wall of the rejector portion of the body.

14. A body for a Stirling cycle system, the body having an acceptor portion with a plurality of passageways formed at least in part therein, an outer wall of a regenerator portion, and an outer wall of a rejector portion, with the acceptor portion being fluidly coupled to the regenerator portion and the regenerator portion being fluidly coupled to the rejector portion, the acceptor portion, the outer wall of the regenerator portion and the outer wall of the rejector portion being of one-piece construction.

15. The body for a Stirling cycle system of claim 14 wherein the body further includes rejector members being of one-piece construction with the acceptor portion, the outer wall of the regenerator portion and the outer wall of the rejector portion, and projecting from the outer wall of the rejector portion of the body.

16. A Stirling cycle system comprising:

an acceptor with a heat conducting planar external surface constructed for positioning adjacent to a heat source to pass heat from the heat source when positioned adjacent to the heat source;

a regenerator fluidly coupled to the acceptor;

a rejector fluidly coupled to the regenerator;

a power piston fluidly coupled to the rejector;

a mover fixedly coupled to the power piston;

a stator electromagnetically coupled to the mover; and a body defining a portion of the acceptor with a plurality of passageways formed at least in part therein, an outer wall of the regenerator, and an outer wall of the rejector, the acceptor portion, the outer wall of the regenerator portion and the outer wall of the rejector portion being of one-piece construction.

17. The Stirling cycle system of claim 16 wherein the acceptor portion of the body has a planar surface with a plurality of channels, and the system further includes an acceptor plate with a planar surface mating with the planar surface of the acceptor portion of the body and having a plurality of channels with the channels of the planar surfaces of the acceptor portion of the body and the acceptor plate together forming a plurality of fluid passageways.

18. The Stirling cycle system of claim 16 wherein the acceptor portion of the body has a plurality of channels, and the system further includes an acceptor member mating with the acceptor portion of the body and having a plurality of channels with the channels of the acceptor portion of the body and the acceptor member together forming a plurality of fluid passageways, the acceptor member having a heat conducting planar external surface for positioning adjacent to the heat source to transfer heat to the acceptor portion of the body from the heat source when the acceptor member is positioned adjacent to the heat source.

19. The Stirling cycle system of claim 16 wherein the body further includes rejector members being of one-piece construction with the acceptor portion, the outer wall of the regenerator portion and the outer wall of the rejector portion, and projecting from the outer wall of the rejector.

20. The Stirling cycle system of claim 16 constructed as an electrical generator wherein the stator is configured to output electrical power.

21. The Stirling cycle system of claim 16 constructed as a cooler wherein the stator is configured to receive electrical power.

22. A heater head assembly for a Stirling cycle system, the heater head assembly comprising:

regenerator material;

a body having an acceptor portion, an outer wall of a regenerator portion, and an outer wall of a rejector portion, with the regenerator portion being sized to receive the regenerator material, the body having an internal volume shaped to receive a displacer, the acceptor portion, the outer wall of the regenerator portion and the outer wall of the rejector portion being of one-piece construction, the acceptor portion having a conically shaped portion and a planar surface with a plurality of channels; and an acceptor plate with a planar surface mating with the planar surface of the acceptor portion of the body and having a plurality of channels with the channels of the planar surfaces of the acceptor portion of the body and the acceptor plate together forming a plurality of fluid passageways.

23. The heater head assembly of claim 22 wherein the body further includes rejector members being of one-piece construction with the acceptor portion, the outer wall of the regenerator portion and the outer wall of the rejector portion, and projecting from the outer wall of the rejector portion of the body.

24. The heater head assembly of claim 22 further comprising a member fluidly coupled to the rejector portion of the body, the member having ports configured for fluid coupling with a power conversion component of the Stirling cycle system.

25. The heater head assembly of claim 22 wherein the plurality of fluid passageways opening into the internal volume and fluidly communicate with the regenerator material in the regenerator portion.

* * * * *